United States Patent [19]

Henry et al.

[11] Patent Number: 4,830,889

[45] Date of Patent: May 16, 1989

[54] CO-DEPOSITION OF FLUORINATED CARBON WITH ELECTROLESS NICKEL

[75] Inventors: James R. Henry, Rock Island; Ernest M. Summers, Moline, both of Ill.

[73] Assignee: Wear-Cote International, Inc., Rock Island, Ill.

[21] Appl. No.: 99,234

[22] Filed: Sep. 21, 1987

[51] Int. Cl.[4] ..... C23C 3/02

[52] U.S. Cl. ..... 427/438; 427/437

[58] Field of Search ..... 427/438, 437

[56] References Cited

U.S. PATENT DOCUMENTS 3,756,925 9/1973 Hirakata .
3,778,391 12/1973 Morris ..... 524/546
3,787,294 1/1974 Kurosaki et al. .
4,302,374 11/1981 Helle et al. .

FOREIGN PATENT DOCUMENTS 2353881 5/1974 Fed. Rep. of Germany ..... 524/546

OTHER PUBLICATIONS

"Fluorad" Technical Information Sheet 3M Commercial Chemicals Div. 3M 1985, issued 2/85.

*Primary Examiner*—Sam Silverbert
*Attorney, Agent, or Firm*—Henderson & Sturm

[57] ABSTRACT

A process for co-depositing fluorinated carbon with electroless nickel which provides a uniformly dispersed co-deposit. The process includes the use of a non-ionic, wetting agent in combination with a cationic wetting agent for the suspension of fluorinated carbon in the electroless nickel solution.

10 Claims, No Drawings

CO-DEPOSITION OF FLUORINATED CARBON WITH ELECTROLESS NICKEL

TECHNICAL FIELD

This invention relates to metal plating and more particularly to the co-deposition of fluorinated carbon with electroless metal platings. BACKGROUND ART Today's broad spectrum of electroless plating technology and its commercial uses is credited to Brenner and Riddell of the U.S. National Bureau of Standards in the 1940's. Their efforts in controlling this unique chemical reaction has led to electroless chemistry emerging today as one of the leading growth areas in metal finishing. It is estimated that the markets for this chemistry will increase at a rate of 12 to 15% per year into the 1990's.

Primarily, electroless nickel, copper and gold represent the majority of the electroless market, with electroless nickel being the most widely used. Other electroless deposits (i.e., palladium, cobalt, silver, and tin) have had very limited industrial use and/or development.

Electroless plating refers to the autocatalytic or chemical reduction of aqueous metal ions plated to a base substrate. The process differs from immersion plating in that deposition of the metal is autocalytic, or continuous.

Electroless deposit (i.e., nickel, copper, gold, etc.) has unique metallurgical characteristics. However, the major engineering advantages of electroless plating include: uniformity (±0.0001"/side possible); excellent corrosion resistance; wear and abrasion resistance; non-magnetic and magnetic properties; solderability; high hardness; amphorous (microcrystalline) deposit; excellent adhesion; low coefficient of friction; high reflectivity; EMI/RFI shielding; preplate for precious metal plating; heavy deposits; deposits onto wide range of metallics and non-metallics.

THE ELECTROLESS BATH

Components of the electroless bath include an aqueous solution of metal ions, catalyst, reducing agent(s), complexing agent(s), and bath stabilizer(s) operating in a specific metal ion concentration, temperature and pH range.

Unlike convention electroplating, no electrical current is required for deposition. The electroless bath provides a deposit which follows all contours of the substrate exactly, without building up at the edges and corners. A sharp edge receives the same thickness of deposit as a blind hole.

The base substrate being plated must be catalytic in nature. A properly prepared workpiece provides a catalyzed surface and, once introduced into the electroless solution, a uniform deposition begins.

From the minute amounts of the electroless metal (i.e., Ni, Cu) itself will catalyze the reaction, so the deposition is autocatalytic after the original surfaces are coated.

Electroless deposition then continues, providing that the metal ion and reducing agent are replenished—however, if or evolved gas are trapped in a blind hole or downwardly facing cavity, this will prevent electroless deposition in these areas.

In electroless plating, metal ions are reduced to metal by the action of chemical reducing agents which are simply electron donors. The metal ions are electron acceptors which react with electron donors. The catalyst is the substance (workpiece or metallic surface) which accelerates the electroless chemical reaction, allowing oxidation of the reducing agent.

The following chemical formulae illustrate an "electroless reaction", i.e., electroless nickel (sodium hypophosphite reduced; acid bath:

$$[H_2PO_2]^- + H_2O \xrightarrow[\text{Heat}]{\text{Catalyst}} H^+ + [HPO_3]^= + 2H \quad (1)$$

$$NI^{++} + 2H \longrightarrow Ni + 2H^+ \quad (2)$$

$$[H_2PO_2]^- + H \longrightarrow H_2O + OH^- + P \quad (3)$$

$$[H_2PO_2]^- + H_2O \longrightarrow H^+ + [HOP_3]^= + H_2 \uparrow \quad (4)$$

The metal ion and reduced concentration must be monitored and controlled closely in order to maintain proper ratios and to maintain the overall chemical balance of the plating bath. The electroless plating deposition rate is controlled by temperature, pH and metal ion/reduced concentration. Each of the particular plating reactions has optimum ranges at which the bath should be operated.

Complexing agent(s) act as a buffer to help control pH and maintain control over the "free" metal salt ions available to the solution, thus allowing solution stability. The stabilizer(s) act as catalytic inhibitors, retarding potential spontaneous decomposition of the electroless bath.

Few stabilizers are used in excess of 10 PPM, because an electroless bath has a maximum tolerance to a given stabilizer. Excessive use of stabilization materials can result in depletion of plating rate, bath life and poor metallurgical deposit properties.

Trace impurities and organic contamination (i.e., degreasing solvents, oil residues, mold releases) in the plating bath will affect deposit properties and appearance. Foreign inorganic ions (i.e., heavy metals) can have an equal effect. Improper balance and control will cause deposit roughness, porosity, changes in final color, foreign inclusions and poor adhesion.

SURFACE PREPARATION

Since electroless plating is a chemical reduction process, proper surface preparation of the base metal is vital to achieving a sound electroless deposit. Improper adhesion, deposit porosity, roughness and skip plating can all occur from an improperly prepared substrate.

Faulty preparation may be caused by poor choice of pretreatment chemicals, cycle process, equipment, substrate or deviations in the cycle process. Chemicals should be dated and maintained as required. Cycle process should be the best available for the specific substrate and control parameters adhered to.

A properly prepared substrate is one where all surface contamination has been removed mechanically and/or chemically, maintaining its dimensional tolerances and exposing the substrate to its virgin or activated stage for electroless plating.

Typical surface contamination: oxides, rust; buffing compounds; oils, greases, metalworking lubricants; weld scale; organic material; solder flux. Mechanical pretreatment: abrasive cleaning; degaussing; pre-heat treatment; shot peening; vibratory or tumble finishing. Chemical pretreatment: solvent (vapor) degreasing; alkaline electrocleaning; etching (pickling); alkaline soak cleaning; alkaline periodic reverse; immersion plate (i.e., zincate, stannous chloride, palladiuum chloride); electrolytic strike; galvanic initiation.

EQUIPMENT

A critical component of any electroless plating system is the equipment. Any micron-sized bath impurities such as dust, sand, loose maskants, etc., must be purged continuously or quality will suffer.

Electroless solutions, particularly electroless nickel and copper, should have constant filtration at a rate of at least six turnovers of the bath per hour through low-micron units. Due to the chemical reduction that occur and resultant hydrogen gas evolution, air agitation is required.

In the case of electroless nickel and copper, stress relieved polypropylene is the normal material of tank construction. Other materials include passivated stainless steel and glass.

Heating is accomplished either internally or externally in cooperation with a special pump and filtration system. Care must be taken in choosing a heating system that will provide excellent temperature stability with no localized heating. In these areas, a specialist's advice should be sought during the design stage to ensure quality is achieved and maintained.

POLLUTION CONTROL

The electroless reaction creates non-contributory by-products, therefore, electroless baths must be periodically treated and disposed. First must be conscientious of meeting EPA disposal concentrations. The most common methods involve the use of electrolytic cells to plate out residual metal, precipitation of metal hydroxide, metal reduction using borohydride, ion exchange and reverse osmosis.

NICKEL

The most widely used and accepted engineering form of electroless plating is by far electroless nickel. Marked improvements in solution stability, equipment, pretreatment cycles and reducing agents have given electroless nickel a very bright future.

Electroless nickel offers unique deposit properties including uniformity of deposit in deep recesses, bores and blind holes. Other features are excellent corrosion, wear and abrasion resistance, ductility, lubricity, solderability, electrical properties and high hardness.

The alloy can be deposited onto a wide range of substrates including carbon steels, stainless and high alloy steels, iron, aluminum, copper, brass, bronze, beryllium, plastics, epoxy and other non-conductors.

Electroless nickel baths may consist of four types: alkaline nickel phosphorus; acid nickel-phosphorus; alkaline nickel-boron; and acid nickel-boron. The chemical reducing agent most commonly used is sodium hypophosphite. Others include sodium borohydride, n-dimethylamine borane (DMAB), n-diethylamine borane (DEAB) and hydrazine.

Alkaline nickel-phosphorus deposits are generally reduced by sodium hypophosphate. These alkaline baths are formulated mostly at low temperatures for plating on plastics.

Deposits provide good solderability for the electronics industry and energy operating costs are reduced to some solutions' low operating temperatures. Less corrosion protection, however, adhesion to steel and difficulty in processing aluminum due to high pH values are drawbacks.

A low temperature bath can produce hard as deposited values of 700 VHN at 2% phosphorus. The phosphorus content can be varied by changing the operating temperature of the bath. One such bath consists of the following components:

| | |
|---|---|
| Nickel sulfate | 30 g/L |
| Sodium Hypophosphite | 30 g/L |
| Sodium Pyrophosphate | 60 g/L |
| Triethanolamine | 100 ml/L |
| pH | 10.0 |
| Temperature | 30–35° C. (86°–95° F.) |

An example of a high temperature alkaline, electroless nickel phosphorus bath is:

| | |
|---|---|
| Nickel sulfate | 33 g/L |
| Sodium citrate | 84 g/L |
| Ammonium chloride | 50 g/L |
| Sodium hypophosphite | 17 g/L |
| pH | 9.5 |
| Temperature | 85° C. (185° F.) |

Acid, nickel-phosphorus deposits normally consist of 88 to 94% nickel and 6 to 12% phosphorus operating at 77° to 93° C. (171° to 200° F.) with a pH of 4.4 to 5.2. The reducing agent is commonly sodium hypophosphite.

The pH of the solution is the controlling factor affecting the phosphorus content of the deposit. In general, the higher the pH, the lower the phosphorus content, resulting in deposit property changes.

Lower phosphorus containing deposits (i.e., 6%) typically have less corrosion resistance than 9% alloys. Also, deposits containing phosphorus in excess of 8.0% are typically non-magnetic. When the pH drops below 4.0, subsequent nickel deposition virtually stops.

As deposited, nickel-phosphorus hardness is 500 to 600 VHN, while maximum values of 950 VHN or slightly more may be realized by post-heat-treatment of the coating at a temperature of 400° C. (752° F.) for one hour. The temperature is a dominant factor in determining the final deposit hardness.

Careful consideration should be given to the choice of temperature so as not to affect structural changes of the base substrate. Additionally, low temperatures are used—116° C. (240° F.)—to relieve any hydrogen embrittlement that may be produced from pretreatment cycles or subsequent electroless nickel deposition.

Post-baking of the deposit produces marked structural changes in hardness, wear and abrasion resistance. Dependent upon the temperature, bath composition and phosphorus content, this post-treatment cycle will totally change the initial microcrystalline structure, resulting in nickel phosphides to be precipitated, creating a very hard matrix.

Complete precipation of nickel phosphides does not occur at temperatures significantly below 400° C. (752° F.). In general, deposits with 9.0 phosphorus and above tend to produce lower as deposited hardness values but give slightly higher hardness when post-heat treated. The coating will discolor above 250° C. (482° F.) in an air atmosphere.

Prevention of coating discoloration can be accomplished in a vacuum, inert or reducing atmosphere oven. Physical properties affected by the post-heat treatment include increasing magnetism, adhesion, tensile strength and electrical conductivity while decreasing ductility, electrical resistivity and corrosion resistance of the deposit.

Thickness of the nickel-phosphorus deposit generally ranges from 2.5 to 250 μm (0.1 to 10.0 mils). Deposits less than 2.5 μm and greater than 625 μm are currently and successfully being performed.

Thickness measurements can be carried out with magnetic devices, micrometers, coulometrics, beta backscatter and x-ray fluoresence.

A partial listing of current applications, by major industries, for acid nickel-phosphorus include: aerospace and military splines; fluid pumps; fuse assemblies; optical mirrors; firearm components; propellar shafts; and landing gear components. Automotive heat sinks; knuckle pins, transmission thrust washers; valve inserts. Computer memory discs; guides; and drives. Electronic diode cans; rotor cups; connector pins; and gold replacement. Fluid power components. Food processing and packaging equipment. Foundry tooling. Medical instruments and equipment. Petro/chem pumps; impeller; valves; oil well packers; and sucker rods. Plastic tools and dies; and extruder screws. Printing press machinery.

The following is an example of an acid, hypophosphite reduced bath.

| | |
|---|---|
| Nickel sulfate | 28 g/L |
| Sodium acetate | 17 g/L |
| Sodium hypophosphite | 24 g/L |
| Lead acetate | 0.0015 g/L |
| pH | 4.6 |
| Temperature | 82–88° C. (180–190° F.) |

most current applications for boron reduced electroless nickel have centered around the electronic industry. Nickel-boron deposits have good solderability, brazing, high hardness, high melting point, and are used as a replacement for rhodium and gold.

As compared to nickel-phosphorus alloys, drawbacks of nickel-boron include poor corrosion resistance, strength and ductility. Electronic applicants include wire and die bonding, PC boards for high temperature service, contacts for burn-in cabinets, integrated circuits and solar electrical conversion devices.

Alkaline nickel-boron solutions utilize the powerful reducing agent, sodium borohydride, to produce a deposit containing 5 to 6% boron and 94 to 95% nickel by weight. These highly alkaline solutions operate at a pH of 12.0 to 14.0 and temperatures of 90° to 95° C. (195° to 205° F.).

These baths tend to be less stable because of their high alkalinity, and bath decomposition may occur if the pH falls below 12.0. As deposited hardness values of 650 to 750 VHN are typical.

After post-heat treatment at 400° C. (752° F.) for one hour, values of 1200 VHN can be produced. The melting point of borohydride reduced deposits is 1080° C. (1975° F.).

The following is an example of a sodium borohydride reduced electroless nickel bath.

| | |
|---|---|
| Nickel chloride | 31 g/L |
| Sodium hydroxide | 42 g/L |
| Ethylenediamine 98% | 52 g/L |
| Sodium borohydride | 1.2 g/L |
| Thallium nitrate | 0.0022 g/L |
| pH | 14.0 |
| Temperature | 93–95° C. (200–205° F.) |

Acid nickel-boron varies from 0.1 to 4% boron by weight depending on the bath formulation. The boron content of electroless nickel is reduced by either n-dimethylamine borane (DMAB) or n-diethylamine borane (DEAB).

Both parameters include a pH of 4.8 to 7.5 with an operating temperature range of 65° to 77° C. (149° to 171° F.). DMAB or DEAB reduced deposits have a very high melting temperature of 1350° C. (2460° F.). Baths containing less than 1% boron have excellent solderability and good ultrasonic (wire) bonding characteristics.

A typical DMAB reduced bath contains:

| | |
|---|---|
| Nickel sulfate | 25 g/L |
| Sodium acetate | 15 g/L |
| DMAB | 4 g/L |
| Lead acetate | 0.002 g/L |
| pH | 5.9 |
| Temperature | 26° C. (78° F.) |

COMPOSITES

The uniform dispersion of micron (<10 μm or <0.4 mil) or sub-micron particles in an electroless metal deposit will enhance the wear, abrasion resistance and/or lubricity over base substrates and conventional electroless deposits. Composites containing fluoropolymers (PTFE), natural and synthetic (polycrystalline) diamonds, ceramics, chromium carbide, silicon cabride and aluminum oxide have been co-deposited.

Most commercial deposition occurs with an acid electroless nickel bath due to its unique physical characteristics available to the final co-deposit The reducing agent used may be either a hypophosphite or boron complex.

The inclusion of these finely divided particles within an electroless matrix (25 to 30% by volume) involves the need to maintain uniform dispersion of the foreign material during metal deposition. Specialized equipment is required and part size, configuration and deposit thickness are limited.

Deposition rates will vary, depending upon the type of electroless bath utilized. The surface morphology of the inclusion (i.e., type, size, distribution in the matrix) will greatly influence the final co-deposit properties and composition. Wear resistance is related to particle size and concentration in the electroless bath.

Applications include molds for rubber and plastic components, fasteners, precision instrument parts, mating components, drills, gauge blocks, tape recording heads and guides for computers.

Due to the resultant matrix surface topography (when using diamonds or silicon carbide, for example), the final surface roughness must be considered. Special post plate surface finish operations must be employed to regain the required RMS (microinch) finish.

In severe abrasion applications involving high pressure foundry molding, it has been noted that the softer electroless nickel matrix wears first, exposing harder composite particles which create poor drawability of the resin/binder from the mold.

Although fluorinated carbon has been co-deposited directly on the substrate surface in electroplating processes, the co-deposition in electroless plating processes has not been successful. Known processes for electroless co-deposition of PTFE has been accomplished after an initial thickness of metal is first plated on the substrate.

Since fluorinated carbon has excellent properties as a solid lubricant, attempts have been made to utilize this property by co-depositing the fluorinated carbon with electroless nickel. However, satisfactory co-deposition of fluorinated carbon in electroless plating has been heretofore unattainable.

DISCLOSURE OF THE INVENTION

The present invention provides a process for co-depositing fluorinated carbon with electroless nickel which provides a uniformly dispersed co-deposit. The process includes the use of a non-ionic wetting agent in combination with a cationic wetting agent for the suspension of fluoronated carbon in the electroless nickel solution.

an object of the present invention is the provision of an improved process for the co-deposition of fluorinated carbon with electroless nickel.

These and other attributes of the invention will become more clear upon a thorough study of the following description of the best mode for carrying out the invention, particularly when reviewed in conjunction with the examples.

BEST MODE FOR CARRYING OUT THE INVENTION

The following examples are illustrative of the best mode for carrying out the invention. They are obviously not to be construed as limitative of the invention since various other embodiments can readily be evolved in view of the teachings provided herein.

The fluorinated carbon ($CF_x$) used in the following Examples was ACCUFLUOR® $CF_x$, Fluorinated Carbon-Grade 1030 supplied by Allied Corporation, Chemical Sector, P.O. Box 1053R, Morristown, N.J. 07960-1053. The fluoronated carbon was made by reacting coke with elemental fluorine and conformed to the following specifications:

| | |
|---|---|
| Combined Fluorine content (%) | 63 |
| Density (g/cc) | |
| True | 2.74 |
| Bulk | 0.4 |
| Decomposition temperature (°C.) (TGA, 10° C./min) | 630 |
| Surface area ($m^2$/gram): | 150–180 |
| Particle size (median microns): | 3.3 |
| Particle size range (microns): | <1 to 6 |

Fluorinated carbode made by reacting various carbon black feedstocks with elemental fluorine is also available and conforms to the following specifications:

| | |
|---|---|
| Combined Fluorine content (%) | 11–65 |
| Density (g/cc) | |

-continued

| | |
|---|---|
| True | 1.9–2.5 |
| Bulk | 0.09–0.1 |
| Decomposition temperature (°C.): (TGA, 10° C./min) | 380–500 |
| Surface area ($m^2$/gram): | 170–340 |
| Particle size (median micrometers) | <1 |

The electroless nickel bath used in the following Examples was of the following composition:

| | |
|---|---|
| Nickel sulfate | 28 g/L |
| Sodium acetate | 17 g/L |
| Sodium hypophosphite | 24 g/L |
| Lead acetate | 0.0015 g/L |
| pH | 4.5–4.6 |
| Temperature | 82–88° C. (180–190° F.) |

EXAMPLE 1

A premix suspension of $CF_x$ fluorinated carbon particles was prepared as follows:

| | |
|---|---|
| 500 ml | deionized $H_2O$ |
| 5 ml | alkylphenoxypolyethoxy ethanol (Triton X-100) Rohm & Haas nonionic surfactant |
| 100 gm | $CF_x$ fluorinated carbon |

Mix above for approximately 1 hour to form wetted suspension. Adjust to pH with ammonium hydroxide or dilute sulfuric acid. A 3800 ml electroless nickel bath was prepared. An equivalent of 10 gm/liter $CF_x$ particles in suspension was added to the electroless nickel bath with mild agitation (magnetic stirrer). The electroless nickel bath was heated to 180°–185° F. and the pH was adjusted to 4.5–4.6 with $NH_4OH$ or $H_2SO_4$. Steel test panels were plated for 45 minutes, $1\frac{1}{2}$ hour and 2 hours. Plating was good, but no particles were co-deposited. Plating rate was 0.0004"/hour.

EXAMPLE 2

The conditions were the same as in Example 1, except the concentration of $CF_x$ particles was increased to 20 gm/liter. Again, plating was good, but no particles were co-deposited. Plating rate was 0.0004"/hour.

EXAMPLE 3

An identical path bath to that used in Example 2 was prepared. To this bath was added 0.01 volume percent (V/O) Fluorad FC-135 (cationic-fluorinated quaternary ammonium iodides, 3-M Co.)

Steel panels were plated for 1 hour. The plated panels showed a uniform dispersion of $CF_x$ particles throughout the surface and in cross section throughout the thickness of the coating. Increased FC-135 concentration up to 0.05 V/O appeared to be beneficial. Beyond 0.05 V/O may even have an adverse effect. Plating rate was 0.0004"/hour.

EXAMPLE 3-A

The conditions of Example 3 were duplicated except the concentration of $CF_x$ was increased to 30 gm/liter. The resulting test panels showed some increase in particle distribution. The plating was somewhat smutty. Plating rate was 0.00035"/hour.

EXAMPLE 3-A-1

Example 3-A was repeated, except the electroless nickel bath was old (5 regenerations). Good particle distribution was observed; however, plating was somewhat dusty or smutty. Plating appeared to initiate faster than in Examples 3 and 3A. Plating rate was 0.0004"/hour.

EXAMPLE 4

An electroless nickel bath was prepared as in Example 1. The $CF_x$ suspension was added to the equivalent of 25 gm/liter $CF_x$ in the bath. Test panels were plated 1 hour and showed no $CF_x$ particles in the deposit.

EXAMPLE 5

To the plating bath used in Example 4, 0.05 V/O Fluorad FC-99 (amine perfluoralkyl sulfonates) anionic surfactant, (3-M Co.) was added. Test panels plated 1 hour showed no $CF_x$ co-deposition. Increasing the FC-99 to 0.1 V/O had no effect on particle decomposition.

EXAMPLE 6

An electroless nickel bath was prepared as in Example 1. A $CF_x$ suspension was prepared as follows:

| | |
|---|---|
| 500 ml | deionized $H_2O$ |
| 0.5 V/O | Fluorad FC-170-C (fluorinated alkylpolyoxethylene ethanols) non ionic surfactant. |
| 100 gm | $CF_x$ fluorinated carbon. |

Mix approximately 1 hour to form a wetted suspension. An equivalent of 20 gm/liter of $CF_x$ particles in suspension was added to the electroless nickel plating bath. Test panels were plated 1 hour. The resulting deposit contained dispersed $CF_x$ particles, but fewer than Example 3. Plating rate was 0.0004/hour.

EXAMPLE 7

0.5 V/O Triton X-100 (Rohm & Haas) was added to the plating bath used in Example 6. Test panels were plated for 1 hour. $CF_x$ particle dispersion was very poor. Plating rate was 0.0004"/hour.

EXAMPLE 8

An electroless nickel plating bath was prepared as in Example 1. A $CF_x$ suspension was prepared as follows:

| | |
|---|---|
| 500 ml | deionized $H_2O$ |
| 0.5 V/O | Fluorad FC-170-C nonionic surfactant (3-M Co.) |
| 0.05 V/O | Fluorad FC-99 anionic surfactant (3-M Co.) |
| 100 gms | $CF_x$ particles |

Stirred for approximately 1 hour. An equivalent of 20 gm/liter of $CF_x$ particles in suspension was added to the plating bath. Test panels were plated for 1 hour and 2 hours. Excessive foam. Poor co-deposition of particles was observed. Plating rate was 0.0004"/hour.

EXAMPLE 9

Same plating bath as Example 8, except the temperature was lowered to 170°-175° F. Foaming was still excessive. Poor particle co-deposition was observed. Plating rate was 0.00025"/hour.

EXAMPLE 10

An electroless nickel bath was prepared as in Example 1. A $CF_x$ suspension was prepared as follows:

| | |
|---|---|
| 500 ml | deionized $H_2O$ |
| 1.0% V/O | nonylphenoxypoly (ethyloneoxy) ethanol non-ionic surfactant (GAF IGEPAL CO-720) |

Stirred for approximately 1 hour (magnetic stirrer). $CF_x$ suspension equivalent to 10 gm/liter was added to the electroless nickel plating bath. Test panels were plated for 1 hour. Plating looked good; however, no particle deposition was observed. Plating rate was 0.0004"/hour.

EXAMPLE 11

A plating bath as in Example 10 was prepared with the addition of 0.02 V/O Fluorad FC-135 (3-M Co.). Test panels were plated 1 hour and 2 hours; had good particle deposition. Plating rate was 0.0035"/hour.

EXAMPLE 12

An electroless nickel plating bath was prepared as in Example 1. A $CF_x$ suspension was prepared as follows:

| | |
|---|---|
| 500 ml | deionized $H_2O$ |
| 1.0% V/O | IGEPAL CO. - 720 nonionic surfactant (GAF Co.) |
| 100 gm | $CF_x$ particles |

Stirred for approximately 1 hour with a magnetic stirrer. $CF_x$ suspension equivalent to 20 gm/liter of particles was added to the plating bath. 0.02 V/O Fluorad FC-135 cationic surfactant (3M Co.) was added. Test panels were plated for 1 hour and 2 hours. Plating was somewhat streaked and blotchy, but exhibited good uniform particle distribution.

EXAMPLE 13

An electroless nickel bath was prepared as in Example 1. An equivalent of 30 gm/L of $CF_x$ particles was added to the plating bath. Same suspension make up as in Example 12, 0.02 V/O Fluorad FC-135 cationic surfactant (3M Co.) and 0.01 V/O Fluorad FC-99 anionic surfactant (3M Co.) was added. Panels were plated at 175° F. for 1 and 2 hours. Plating rate 0.00035"/hr. Results were poor, little or no particle co-deposition.

EXAMPLE 14

Repeat of Example 13 with temperature at 185° F. Still poor results with little or no particle co-deposition. Panels plated 1 and 2 hours. Plating rate 0.0004"/hr.

EXAMPLE 15

An electroless nickel bath was prepared as in Example 1. An equivalent of 30 gm/L of $CF_x$ particles was added to the plating bath (same suspension as Example 12). Fluorad FC-135 cationic surfactant increased to 0.1 V/O. Panels were plated 1 and 2 hours. Poor particle deposition, panels were streaked, pitted and blotchy. Plating rate 0.00035"/hr.

EXAMPLE 15-A

Same bath as Example 15 after dummy plating for 1 day. Higher concentration of Fluorad FC-135 still gave poor results. Streaks, pits, etc. Little or no particle deposition. Plating rate 0.00035"/hr.

EXAMPLE 16

An electroless nickel bath was prepared as in Example 1. A $CF_x$ suspension was prepared as follows:

| | |
|---|---|
| 500 ml | deionized $H_2O$ |
| 1.0 V/O | IGEPAL CO. - 720 nonionic surfactant (GAF Co.) |
| 100 gm | $CF_x$ particles |

Stirred for approximately 1 hour. A suspension equivalent of 30 gm/L $CF_x$ particles was added to the plating bath. 0.02 V/O Fluorad FC-99 anionic surfactant was added. Test panels were plated 1 and 2 hours. Plating lood good, but no particles were co-deposited. Plating rate was 0.0004"/hr.

EXAMPLE 17

The same plating bath as in Example 16, with addition of 0.02 V/O Fluorad FC-170-C non ionic surfactant (3M Co.). Test panels were plated for 1 and 2 hours. Plating was good, but no particles were co-deposited. Plating rate was 0.0004"/hr.

EXAMPLE 18

A plating bath was made up the same as in Example 15, with the equivalent of 10 gm/L $CF_x$ particles and an operating pH of 4.6–4.7. Test panels were plated for 1 and 2 hours. Plating was uneven with some particle co-deposition. Plating rate was 0.0004"/hr.

EXAMPLE 18A

Same bath as in Example 18, with a pH lowered to 4.4. Test panels plated 1 and 2 hours showed some improvement in appearance, but only fair co-deposition of particles. Plating rate was 0.00035"/hr.

EXAMPLE 19

Same plating bath made up as in Example 18 with $CF_x$ particles increased to 20 gm/L and pH 4.6–4.7. Test panels were plated 1 and 2 hours. Plating looked good, but poor particle deposition. Plating rate was 0.0004"/hr.

EXAMPLE 19A

Same plating bath as in Example 19, but pH was lowered to 4.4. Test panels were plated 1 and 2 hours. Plating still good, but poor particle deposition. Plating rate was 0.00035"/hr.

EXAMPLE 20

An electroless nickel bath was prepared as in Example 3, with $CF_x$ suspension equivalent to 25 gm/L added. The following parts were plated.

1. Plastic mold, A-2 tool steel—0.003"–0.0005";
2. Turbo sugar charger, nickel alloy, steel, silver braze, 0.001";
3. Wear bushings, steel, 0.0005"–0.0007";
4. Pneumatic cylinders, aluminum, 0.0005"–0.0007".

All plated well with uniform dispersion of $CF_x$ particles. Plating rate was 0.00035"–0.0004"/hr.

EXAMPLE 21

An electroless nickel bath was prepared as in Example 12, with $CF_x$ suspension equivalent to 25 gm/L added. The following parts were plated.

1. Disc valve, cast steel, 0.001";
2. Impeller, brass and stainless steel, 0.005";
3. Pneumatic cylinders, aluminum, 0.0005"–0.0007";
4. Roller shaft, aluminum, 0.0005";
5. Print wheel, steel, 0.0005";
6. Thrust runners, Inconel 718, 0.0018–0.0020";
7. Block, multi-metal (ferrous/non-ferrous) combination consisting of steel, aluminum, copper and brass. 0.001"/side.

All parts plates well with uniform dispersion of $CF_x$ particles. Plating rate was 0.0003"–0.0004"/hr.

EXAMPLE 22

Repeat of Example 16 with 0.5 V/O Fluorad FC-170-C. Fair particle deposition; however, distribution was uneven. As bath ages, particle deposition becomes poor and bath coagulates.

EXAMPLE 23

Same make up as Example 22, with 0.02 V/O Fluorad FC-135 cationic surfactant (3M Co.) added. Plated panels were dark and patterned, good particle distibution. Bath plating rate slows after about 0.0003" plating thickness.

EXAMPLE 24

A suspension was prepared as follows:

| | |
|---|---|
| 1000 ml | deionized $H_2O$ |
| 1.0 V/O | IGEPAL CO. - 720 (GAF Co.) nonionic |
| 0.13 V/O | Fluorad FC-135 (3M Co.) cationic |
| 100 gm | $CF_x$ particles |

Stirred for approximately 1 hour. An electroless nickel bath was prepared as in previous examples. The equivalent of 20 gm/L of $CF_x$ particles in suspension was added. Panels were plated for 1 hour. Plating was poor, but good particle distribution was observed. Wetter(s) "oil out" with use causing uneven particle suspension, foaming in the plating bath, and also resulted in skip plating. Plating rate was 0.0003"/hr.

EXAMPLE 25

A suspension was prepared as follows:

| | |
|---|---|
| 500 ml | deionized $H_2O$ |
| 1.0 V/O | Avanel N—1525/90 nonionic surfactant (Mazer Chemical Co.) |
| 76 gm | $CF_x$ particles (equivalent to 20 gm/L in plating bath) |

Stirred for approximately 1 hour. An electroless nickel bath was prepared, as in previous examples. The above suspension was added. Panels were plated for 1 hour. Fair particle distribution was observed; however, bath began to coagulate after continued use and some particles clumped. Plating rate was 0.0003"/hr.

EXAMPLE 26

A suspension was prepared as follows:

| | |
|---|---|
| 500 ml | deionized $H_2O$ |
| 1.0 V/O | Avanel 1525/90 nonionic surfactant (Mazer Co.) |
| 0.76 ml | (0.02 V/O in plating bath) Fluorad FC-135 cationic surfactant (3M Co.) |
| 76 gm | $CF_x$ grade 1030 particles. |

Stirred for approximately 1 hour to form a wetted suspension. An electroless nickel bath was prepared as in Example 1. The above was added to the plating bath. (Equivalent to 20 gm/L $CF_x$ particles). Panels were plated for 1 and 2 hours. Particle dispersion was uniform and excellent. Plating rate was 0.00035"/hr. Slight pitting was observed.

EXAMPLE 27

A $CF_x$ suspension and an electroless nickel bath was prepared as in Example 3 with a $CF_x$ suspension equivalent to 25 gm/L added. SAE 4620 steel rings (Falex Corp.) were plated at the same time for subsequent "block on ring" (ASTM G-77) wear and co-efficient of friction testing as follows:

| | |
|---|---|
| 2 rings | 0.001"/side |
| 2 rings | 0.001"/side and post bake cycle. |

The post bake cycle was performed per MIL-G-6875G at 650° for 8 hours minimum.

EXAMPLE 28

A $CF_x$ suspension and an electroless nickel bath was prepared as in Example 12 with a $CF_x$ suspension equivalent to 25 gm/L added. SAE 4620 steel rings (Falex Corp.) were plated at the same time for subsequent "block on ring" (ASTM G-77) wear and co-efficient of friction testing as follows:

| | |
|---|---|
| 2 rings | 0.001"/side |
| 2 rings | 0.001"/side and post bake cycle. |

The post bake cycle was performed per MIL-G-6875G at 650° for 8 hours minimum.

EXAMPLE 29

An electroless nickel bath as preapred as in the previous examples, except no $CF_x$ suspension was added. SAE 4620 steel rings (Falex Corp) were plated at same time for subsequent "block on ring" (ASTM G-77) wear and coefficient of friction testing as follows:

| | |
|---|---|
| 2 rings | 0.001"/side |
| 2 rings | 0.001"/side and post bake cycle. |

The post bake cycle was performed per MIL-G-6875G at 650° for 8 hours minimum.

EXAMPLE 30

"Block on Ring" (ASTM G-77) wear and co-efficient of friction testing was conducted on the rings of Examples 27–29. The rings of Example 29 were used as the control to determine if parts plated with a co-deposited fluorinated carbon-electroless nickel had properties superior to parts plated with conventional electroless nickel. The rings plated in Examples 27 and 28 were plated by the process of Examples 3 and 12, respectively, since the processes of Examples 3 and 12 provided good plating with a heavy, uniformly distributed co-deposit of fluorinated carbon in the plated nickel matrix.

The testing was conducted by Falex corporation, Aurora, Ill. on their Falex Block on Ring machine. The tests were conducted at ambient temperature without lubrication. The specimen rings were rotated at 100 rpm while subjected to a load of five pounds. The specimen block was type H-60 with a hardness HRC 58-63. Table A below summarizes the test results.

TABLE A

| RING | TIME TO WEAR THROUGH 0.001" PLATING (MINUTES) | TEST DURATION MINUTES | COEFFICIENT OF FRICTION 10 min. Min. Max. | 30 min. Min. Max. | 60 min. Min. Max. | 200 min. Min. Max. |
|---|---|---|---|---|---|---|
| Example 29-1 | 7 | 60 | 0.340–0.658 | 0.602–0.800 | 0.696–0.716 | NA |
| 2 | 7 | 60 | 0.440–0.616 | 0.542–0.588 | 0.598–0.618 | NA |
| 3 (HT) | 20 | 60 | 0.604–0.680 | 0.678–0.706 | 0.658–0.746 | NA |
| 4 (HT) | 20 | 60 | 0.624–0.686 | 0.622–0.678 | 0.698–0.784 | NA |
| Example 28-1 | 40 | 60 | 0.204–0.282 | 0.372–0.410 | 0.684–0.800 | NA |
| 2 | 40 | 60 | 0.182–0.214 | 0.450–0.502 | 0.454–0.510 | NA |
| 3 (HT) | 225 | 470 | 0.100–0.125 | 0.095–0.120 | 0.100–0.115 | 0.255–0.300 |
| 4 (HT) | 225 | 270 | 0.198–0.204 | 0.222–0.232 | 0.262–0.282 | 0.374–0.386 |
| Example 27-1 | 40 | 60 | 0.152–0.332 | 0.492–0.644 | 0.736–0.848 | NA |
| 2 | 40 | 60 | 0.312–0.400 | 0.488–0.532 | 0.568–0.600 | NA |
| 3 (HT) | 225 | 230 | 0.300–0.310 | 0.322–0.340 | 0.328–0.344 | 0.332–0.344 |
| 4 (HT) | 225 | 200 | 0.320–0.330 | 0.356–0.364 | 0.388–0.398 | 0.378–0.402 |

The test results clearly show that the rings plated with fluorinated carbon co-deposited with electroless nickel have better lubricity and wear resistance than rings plated with conventional electroless nickel. The test further shows that heat treatment greatly enhances the lubricity and wear resistance.

A review of the Examples indicates that the best results were achieved in the processes of Examples 3, 3A, 3A1, 11, 12, and 26. In these Examples, a non-ionic surfactant was pesent in the amount of about 1.0 volume percent and a cationic fluorinated surfactant was present in the amount of about 0.01 to 0.02 volume percent.

Examples 18, 18A, 19, 19A and 24 show that the cationic fluorinated surfactant concentration as high as 0.1 volume percent yields unsatisfactory results. A concentration of cationic fluorinated surfactant below 0.1 volume percent is critical to achieving a uniform co-deposit of fluorinated carbon.

While only certain preferred embodiments of this invention have been shown and described by way of illustration, many modifications will occur to those skilled in the art and it is, therefore, desired that it be understood that it is intended herein to cover all such modifications that fall within the true spirit and scope of this invention.

I claim:

1. A process for co-deposition of fluorinated carbon with electroless nickel, comprising the steps of:

preparing an electroless nickel plating solution;

preparing a suspension of fluorinated carbon;

mixing said solution and said suspension to form a stable plating bath including fluorinated carbon present in an amount ranging from about 5 to about 50 grams per liter, nickel present in an amount ranging from about 3.0 to about 9.0 grams per liter, a non-ionic non-fluorinated surfactant present in an amount ranging from about 0.1 to about 1.5 volume percent, and a cationic fluorinated alkyl quaternary ammonium iodide surfactant present in an amount ranging from about 0.005 to about 0.1 volume percent; and introducing a workpiece into said stable plating bath and initiating an electroless plating process to form a plated workpiece including a co-deposit of fluorinated carbon uniformly dispersed in a plated nickel matrix.

2. The process of claim 1 further including the step of heat treating said plated workpiece.

3. The process of claim 1 wherein said non-ionic surfactant is present in said suspension.

4. The process of claim 1 wherein said cationic surfactant is present in said suspension.

5. The process of claim 1 wherein said fluorinated carbon is present in an amount ranging from about 20 to about 25 grams per liter.

6. The process of claim 1 wherein said nickel is present in an amount ranging from about 5.0 to about 7.0 grams per liter.

7. The process of claim 1 wherein said non-ionic surfactant is present in an amount of about 1.0 volume percent.

8. The process of claim 1 wherein said cationic surfactant is a fluorinated alkyl quaternary ammonium iodide present in an amount ranging from about 0.01 to about 0.02 volume percent.

9. The process of claim 1 wherein said workpiece is formed of a material selected from a group consisting of steel, A-2 tool steel, nickel alloy, silver, aluminum, cast steel, brass, stainless steel, inconel, and copper.

10. The process of claim 1 wherein said plating process is carried out at a temperature of about 180°–185° F. and a pH of about 4.5–4.6.

* * * * *